US008928487B2

(12) United States Patent
Dyer et al.

(10) Patent No.: US 8,928,487 B2
(45) Date of Patent: Jan. 6, 2015

(54) ADJUSTABLE OCCUPANCY SENSOR AND METHOD OF ATTACHING AN OCCUPANCY SENSOR TO A LIGHT FIXTURE

(75) Inventors: John W. Dyer, Ashland City, TN (US); James V. Olson, Indianapolis, IN (US)

(73) Assignee: Schneider Electric USA, Inc., Palatine, IL (US)

( * ) Notice: Subject to any disclaimer, the term of this patent is extended or adjusted under 35 U.S.C. 154(b) by 1043 days.

(21) Appl. No.: 12/982,672

(22) Filed: Dec. 30, 2010

(65) Prior Publication Data

US 2012/0169507 A1 Jul. 5, 2012

(51) Int. Cl.

| | |
|---|---|
| ***G08B 23/00*** | (2006.01) |
| ***F21V 23/04*** | (2006.01) |
| *G08B 17/10* | (2006.01) |

(52) U.S. Cl.

CPC ..... *F21V 23/0471* (2013.01); *G08B 17/10* (2013.01)

USPC ..... 340/693.11; 340/693.9; 340/693.6; 340/693.5

(58) Field of Classification Search

USPC ..... 340/693.5, 693.11, 693.6, 693.9

See application file for complete search history.

(56) References Cited

U.S. PATENT DOCUMENTS

| | | | | | |
|---|---|---|---|---|---|
| 3,473,017 | A | * | 10/1969 | Lim et al. | 362/221 |
| 4,440,288 | A | * | 4/1984 | Thomas et al. | 198/419.2 |
| 4,510,488 | A | * | 4/1985 | St. Jean et al. | 340/567 |
| D294,231 | S | | 2/1988 | Cameron, Jr. et al. | |
| D320,758 | S | | 10/1991 | Lutz et al. | |
| 5,442,532 | A | * | 8/1995 | Boulos et al. | 362/276 |
| 5,594,422 | A | * | 1/1997 | Huey et al. | 340/628 |
| 5,703,368 | A | * | 12/1997 | Tomooka et al. | 250/349 |
| 5,757,004 | A | * | 5/1998 | Sandell et al. | 250/347 |
| D401,175 | S | | 11/1998 | Bender et al. | |
| D404,325 | S | | 1/1999 | Bender et al. | |
| D404,326 | S | | 1/1999 | Bender et al. | |
| 5,893,470 | A | * | 4/1999 | Peggs | 211/90.01 |
| 5,927,844 | A | * | 7/1999 | Justiniano et al. | 362/147 |
| 5,967,649 | A | * | 10/1999 | Schlesinger | 362/391 |
| 6,011,469 | A | * | 1/2000 | Taft et al. | 340/547 |
| D430,055 | S | | 8/2000 | Aiello et al. | |
| D430,056 | S | | 8/2000 | Aiello et al. | |
| D435,798 | S | | 1/2001 | Aiello et al. | |
| 6,171,559 | B1 | * | 1/2001 | Sanders et al. | 422/300 |

(Continued)

OTHER PUBLICATIONS

Product Bulletin for Cat. Nos. OSFHB-ITW & OSFOA-00W, "Leviton's New Fixture-Mounted Infrared High-Bay Occupancy Sensor & Adapter", 2005 Leviton Manufacturing Co., Inc., 4 pgs.

*Primary Examiner* — Jennifer Mehmood
*Assistant Examiner* — Rufus Point
(74) *Attorney, Agent, or Firm* — Lando & Anastasi, LLP

(57) ABSTRACT

An adjustable occupancy sensor capable of being secured to a light fixture includes a housing having a side and a bottom, a sensor assembly attached to the housing at the bottom of the housing, and an adjustable mounting assembly provided on the side of the housing. The adjustable mounting assembly includes a slot defined in the side of the housing and a track having a plurality of segments extending along the length of the track. The track is configured to be releasably secured to the side of the housing within the slot, the plurality of segments being configured to be breakable from the track to adjust a length of the track. The adjustable mounting assembly further includes a connector molded or otherwise secured to the track to connect the housing of the adjustable occupancy sensor to the light fixture. Other embodiments and methods are disclosed herein.

14 Claims, 7 Drawing Sheets

(56) References Cited

U.S. PATENT DOCUMENTS

| | | | | |
|---|---|---|---|---|
| D439,853 | S | 4/2001 | Aiello et al. | |
| 6,479,823 | B1 * | 11/2002 | Strang et al. | 250/342 |
| 6,522,261 | B2 * | 2/2003 | Scheffler et al. | 340/815.73 |
| D472,486 | S | 4/2003 | Eckel et al. | |
| D472,487 | S | 4/2003 | Eckel et al. | |
| 6,547,587 | B2 * | 4/2003 | Hurst et al. | 439/532 |
| 6,711,871 | B2 * | 3/2004 | Beirise et al. | 52/782.1 |
| D504,627 | S | 5/2005 | Harju | |
| D511,705 | S | 11/2005 | Bandringa et al. | |
| D535,204 | S | 1/2007 | Bender et al. | |
| D548,125 | S | 8/2007 | Bandringa et al. | |
| 7,307,391 | B2 * | 12/2007 | Shan | 315/291 |
| D561,630 | S | 2/2008 | Bandringa et al. | |
| D565,983 | S | 4/2008 | Ni et al. | |
| D565,984 | S | 4/2008 | Lidong et al. | |
| D569,284 | S | 5/2008 | Ni et al. | |
| D569,291 | S | 5/2008 | Ni et al. | |
| D573,053 | S | 7/2008 | Bandringa et al. | |
| D583,688 | S | 12/2008 | Guercio | |
| 7,490,960 | B1 | 2/2009 | Fiorino et al. | |
| D587,613 | S | 3/2009 | Williams et al. | |
| D588,484 | S | 3/2009 | Bandringa et al. | |
| D597,430 | S | 8/2009 | Sloan et al. | |
| D603,284 | S | 11/2009 | Sloan et al. | |
| 7,784,855 | B2 * | 8/2010 | Faass et al. | 296/187.01 |
| D628,103 | S | 11/2010 | Schmalz et al. | |
| 7,824,080 | B2 * | 11/2010 | Gibson et al. | 362/364 |
| D634,048 | S | 3/2011 | Lombardi et al. | |
| 8,231,229 | B2 * | 7/2012 | Kanbara et al. | 353/52 |
| 8,461,510 | B2 * | 6/2013 | Williams et al. | 250/214 AL |
| 8,675,354 | B2 * | 3/2014 | L'Henaff | 361/679.22 |
| 2004/0061611 | A1 * | 4/2004 | Rolf et al. | 340/568.1 |
| 2006/0226328 | A1 * | 10/2006 | Matsumoto et al. | 248/429 |
| 2007/0230197 | A1 * | 10/2007 | Scannell, Jr. | 362/418 |
| 2007/0283525 | A1 * | 12/2007 | Beaudoin et al. | 16/81 |
| 2009/0015426 | A1 * | 1/2009 | Long et al. | 340/825.22 |
| 2009/0128287 | A1 * | 5/2009 | Dragon | 340/5.53 |
| 2009/0147526 | A1 * | 6/2009 | Chien | 362/362 |
| 2010/0019689 | A1 * | 1/2010 | Shan | 315/294 |
| 2010/0134703 | A1 * | 6/2010 | Kanbara et al. | 348/789 |
| 2012/0235579 | A1 * | 9/2012 | Chemel et al. | 315/152 |

* cited by examiner

ADJUSTABLE OCCUPANCY SENSOR AND METHOD OF ATTACHING AN OCCUPANCY SENSOR TO A LIGHT FIXTURE

BACKGROUND OF THE INVENTION

1. Field of the Disclosure

The present disclosure relates to lighting assemblies in general, and more particularly to an adjustable occupancy sensor assembly capable of being secured to a light fixture.

2. Discussion of Related Art

High bay occupancy sensors are designed to control lighting in high mount areas. The occupancy sensors turn lamps of a light fixture on and off based on the occupancy of the space. Such occupancy sensors are configured to detect motion directly below the light fixture and at slant angles from vertical up to 45°. Existing occupancy sensors for light fixtures, such as fluorescent high bay fixtures, are typically incapable of mounting on the fixtures without a special adapter. Specifically, a typical occupancy sensor includes a housing that may be fabricated from molded plastic and a ½-inch NPT ("National Pipe Thread") mounting connector that extends laterally from the housing. The threaded mounting connector is configured to receive wiring that accepts power from and returns switched power to the light fixture. The wiring and connector of the occupancy sensor enter the light fixture at a location known as a "wiring trough," which is a secluded area of the light fixture that is inaccessible to an operator when replacing fluorescent lamps of the light fixture. The wiring trough is a shallow cavity in the light fixture located above the fluorescent lamps. In some light fixtures, the wiring trough entry point is several inches above the level of the bottom fixture edge. For the purposes of this disclosure, this distance may be referred to as an "offset distance." In many light fixtures, the occupancy sensor must be shifted lower than an electrical wiring knockout on an end of the light fixture.

When the offset distance is relatively large, the light fixture housing obscures a significant portion of a viewing range of the occupancy sensor. Lowering the occupancy sensor to a level suitable for operation with respect to a bottom edge of the light fixture is oftentimes not feasible due to the need to access the wiring trough of the light fixture. As mentioned above, one solution is to offer a special adapter, which adds cost and complexity to the installation of the occupancy sensor. One such adapter design incorporates several openings at predetermined intervals to allow the installer of the light fixture to match the offset distance. However, installers of such occupancy sensors often do not anticipate needing an adapter at the time in which the light fixture is installed.

BRIEF SUMMARY OF THE INVENTION

One aspect of the present disclosure is directed to an adjustable occupancy sensor assembly that is provided to detect the presence of a person in a room. In one embodiment, the occupancy sensor assembly has a housing incorporating an adjustable mounting assembly including a slot defined in the side of the housing and a track having a plurality of segments extending along the length of the track. The adjustable mounting assembly further includes a threaded connector molded to the track to connect the housing of the adjustable occupancy sensor to the light fixture. Once the threaded connector and the track are secured to the light fixture, the housing is releasably secured to the track by inserting the track within the slot. In this position, the housing is sufficiently adjustable to accommodate a wide range of offset distances up to six inches in length.

In one embodiment, to shield the components contained within the housing, the elongated slot of the housing includes shielding in the form of the segmented track which is approximately the length of the slot. The segmented track may be segmented with ten or more grooves spaced apart a predetermined distance. The depth of these grooves enables the installer to break the segmented track at an interval corresponding to a preferred location with respect to the light fixture. This construction further enables a portion of the segmented track to be broken off and inserted in the open portion of the slot so as to shield the components housed within the housing of the adjustable occupancy sensor.

Another aspect of the disclosure is directed to a method of installing an adjustable occupancy sensor assembly to a light fixture. In a certain embodiment, the method includes forming an opening in the light fixture by removing a knockout associated with a housing of the light fixture. The knockout and the opening are provided to access wiring of the light fixture. When employing the adjustable occupancy sensor assembly disclosed herein, to adjust the segmented track to a position in which the occupancy sensor can operate optimally, a portion of the segmented track is broken off so that a bottom of the segmented track is flush with the bottom of the light fixture when the occupancy sensor is attached to the light fixture. The housing of the occupancy sensor is attached to the light fixture by inserting the threaded connector associated with the segmented track into the opening in the light fixture and securing the threaded connector with a metallic lock ring. Once secured, the housing of the occupancy sensor is positioned in which the bottom surface of the housing of the occupancy sensor is at a desired position with respect to a bottom of the light fixture. The broken off portion of the segmented track is inserted within a portion of the slot that remains open to block access within an interior of the occupancy sensor.

Another aspect of the disclosure is a method of installing the adjustable occupancy sensor to the light fixture that includes determining an offset distance prior to mounting the housing of the adjustable occupancy sensor to the light fixture and breaking off a portion of the segmented track based on the offset distance. As with the prior method, the broken off portion of the segmented track is inserted within a portion of the slot that remains open to block access within an interior of the adjustable occupancy sensor. Once assembled, the adjustable occupancy sensor is mounted directly to the light fixture.

The adjustable occupancy sensor of the disclosure is capable of mounting directly to the light fixture without the provision of an adapter, thus enabling quick and efficient installation of the sensor. In addition, the adjustable occupancy sensor is designed to accommodate a wide range of offset distances, thus further enabling the sensor to be mounted on a variety of light fixtures.

Another aspect of the disclosure is directed to an adjustable occupancy sensor for a light fixture. In one embodiment, the adjustable occupancy sensor comprises a housing having a side and a bottom, a sensor assembly attached to the housing at the bottom of the housing, and an adjustable mounting assembly provided on the side of the housing. The adjustable mounting assembly includes a slot defined in the side of the housing and a track configured to be releasably secured to the side of the housing within the slot. The adjustable mounting assembly further includes a connector molded to the track to connect the housing of the adjustable occupancy sensor to the light fixture.

Embodiments of the adjustable occupancy sensor include providing the sensor assembly with a circuit board configured to be secured within an interior of the housing. The circuit board has an electronic controller and at least one sensor coupled to the electronic controller. The sensor is configured to detect the presence of a person in a room. In certain embodiments, the sensor assembly further includes a Fresnel lens secured to the housing by a bracket and a finger guard disposed between the circuit board and the Fresnel lens and secured to the housing by the bracket. In other embodiments, the connector includes a threaded connector that is molded or otherwise secured to the track and a threaded fastener configured to be threadably connected to the threaded connector. The threaded connector and the threaded fastener are constructed and arranged to secure the housing of the adjustable occupancy sensor to a housing of the light fixture. The housing includes a pair of rail members defining the slot with the track being configured to be releasably secured to the pair of rail members and positioned within the slot. The track includes an interconnect configuration adapted to mate with an interconnect configuration of the pair of rail members. In one embodiment, the mating interconnect configurations may be a tongue-and-groove structure. The track is slidable within the slot to position the connector at a desired height with respect to the bottom of the housing. The track has a plurality of segments extending in a crosswise direction along the length of the track. The plurality of segments is configured to be breakable from the track to adjust a length of the track. The segments of the track are defined by grooves formed in the track between adjacent segments. In one embodiment, the segments are constructed and arranged to be removable from the track and inserted into the slot adjacent the track. The grooves may extend in a direction perpendicular to a direction of the a length of the track.

Yet another aspect of the present disclosure is directed to a method of installing an occupancy sensor on a light fixture having an opening positioned to access wiring of the light fixture. In a particular embodiment, the method comprises: providing an adjustable occupancy sensor having a housing and a track releasably securable to the housing, the track forming part of the housing of the occupancy sensor when attached to the housing; releasably securing the housing of the occupancy sensor to the track in a position in which a bottom surface of the housing of the occupancy sensor is at a desired position with respect to a bottom of the light fixture; and securing the track to the light fixture, the track having a connector configured to be inserted within the opening in the light fixture.

Embodiments of the method may further include breaking off a portion of the track so that a bottom of the track is flush with the bottom of the light fixture and/or inserting the broken off portion of the track within an opening of the housing of the occupancy sensor to block access to an interior of the occupancy sensor. Other embodiments of the method may include discarding the broken off portion of the track.

A further aspect of the disclosure is directed to an adjustable occupancy sensor configured to be secured to any one of a plurality of light fixtures. In an embodiment, each of the light fixtures has a mounting opening located at a distance from a bottom of the light fixture with the distance being different for each light fixture. The adjustable occupancy sensor comprises a housing having a side and a bottom, a sensor assembly attached to the housing, and means for adjustably securing the housing to the mounting opening of any one of the plurality of light fixtures to locate the sensor assembly at a desired position on one of the plurality of light fixtures.

In a certain embodiment, the means for adjustably securing the housing to the light fixture includes a pair of rail members defining a slot and a track releasably securable to the pair of rail members. The track has a plurality of segments extending in a crosswise direction along the length of the track. The track is configured to be releasably secured to the side of the housing within the slot. The plurality of segments is configured to be broken from the track to adjust a length of the track. The track includes a connector to connect the housing of the adjustable occupancy sensor to the mounting opening. The connector includes a threaded portion that is molded or otherwise secured to the track and a threaded fastener configured to be threadably connected to the threaded portion. The track includes an interconnect configuration adapted to mate with an interconnect configuration of the pair of rail members.

Another aspect of the disclosure is directed to an electronic device configured to be attached to a structure. In one embodiment, the device comprises a housing having a side and a bottom, an electronic component attached to the housing at the bottom of the housing, and an adjustable mounting assembly provided on the side of the housing. The adjustable mounting assembly includes a slot defined in the side of the housing, a track configured to be releasably secured to the side of the housing within the slot, and a connector coupled to the track to connect the housing of the device to the structure. In a particular embodiment, the electronic component may embody a camera, a smoke detector, a light, a light level sensor, a speaker, an indicator, such as an LED indicator, or other type of sensor. The structure may embody a light fixture or a conduit box.

The present disclosure will be more fully understood after a review of the following figures, detailed description and claims.

BRIEF DESCRIPTION OF THE DRAWINGS

In the drawings, each identical or nearly identical component that is illustrated in various figures is represented by a like numeral. For purposes of clarity, not every component may be labeled in every drawing. For a better understanding of the present disclosure, reference is made to the figures which are incorporated herein by reference and in which.

DETAILED DESCRIPTION OF THE INVENTION

Figure 1:
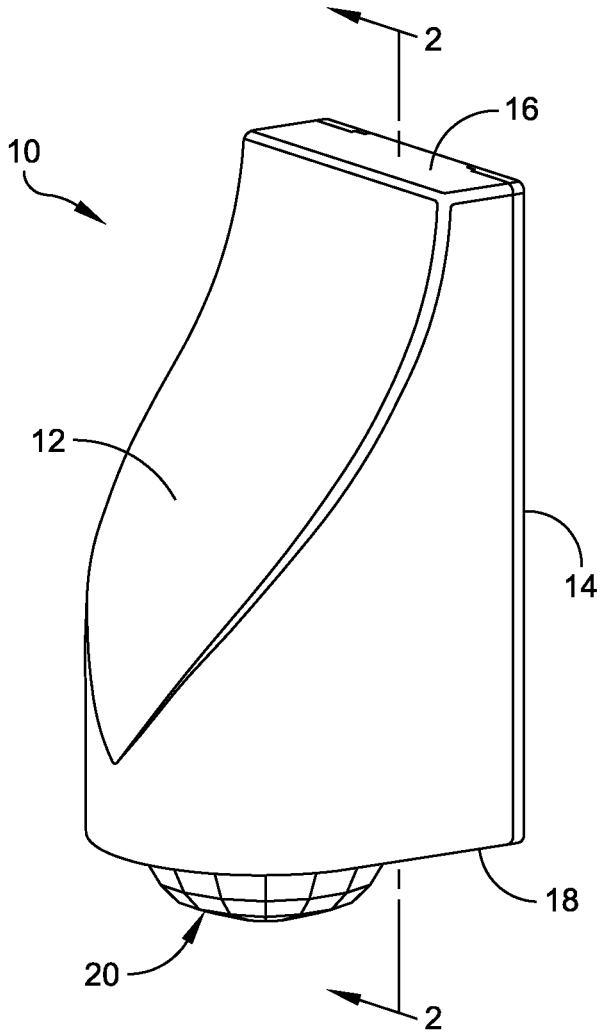
FIG. 1 is a perspective view of an adjustable occupancy sensor of an embodiment of the disclosure.

For the purposes of illustration only, and not to limit the generality, the present disclosure will now be described in detail with reference to the accompanying figures. This disclosure is not limited in its application to the details of construction and the arrangement of components set forth in the following description or illustrated in the drawings. The disclosure is capable of other embodiments and of being practiced or being carried out in various ways. Also the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

The present disclosure is directed to an adjustable occupancy sensor assembly that is provided to detect the presence of a person in a room. Embodiments of the adjustable occupancy sensor assembly disclosed herein are particularly suited for applications within large spaces requiring high bay occupancy sensors. In one embodiment, the occupancy sensor assembly has a housing that is configured to have a built-in adjustable connector to secure the housing to a light fixture, such as a fluorescent light fixture. The housing is sufficiently adjustable to accommodate a wide range of offset distances. For example, in one embodiment, the housing of the adjustable occupancy sensor may accommodate an offset distance of approximately six inches.

One feature of the housing of the occupancy sensor assembly is the provision of a vertical slot formed in the housing and an elongated, segmented track that is configured to be secured to the light fixture. The housing of the occupancy sensor is releasably secured to the segmented track with the segmented track being received within the vertical slot. The width of the slot may be approximately one inch, which corresponds to a diameter of a threaded mounting connector of the occupancy sensor assembly. The length of the slot may be any suitable distance, such as six inches, which, as described above, defines a range of offset distance adjustability. The slot may be integrally formed within the housing or by separate rail members that are secured to the housing.

In one embodiment, the threaded mounting connector is part of the segmented track that is configured to ride within the slot and is captivated within the slot. Recognized safety agencies require the wiring of the light fixture and the wiring of the occupancy sensor to be mechanically shielded from the installer. The elongated slot of the housing includes shielding in the form of the segmented track that is approximately the length of the slot. The segmented track may be segmented with ten or more grooves spaced apart a predetermined distance, such as ⅜ inch. The grooves extend in a direction that is generally perpendicular to the direction of the segmented track. The depth of these grooves allows the installer to break the segmented track at an interval corresponding to a preferred location with respect to the light fixture. This construction enables a portion of the segmented track to be broken off and inserted in the open portion of the slot so as to shield the components housed within the housing of the adjustable occupancy sensor.

Other aspects of the disclosure are directed to methods of installing an adjustable occupancy sensor assembly to a light fixture, such as a fluorescent light fixture. In certain embodiments, the method includes forming an opening in the light fixture by removing a knockout associated with a housing of the light fixture. The knockout and the opening are provided to access wiring of the light fixture. The housing of the occupancy sensor is releasably secured to the segmented track in a position in which the bottom surface of the housing of the occupancy sensor is at a desired position with respect to a bottom of the light fixture when installed. To adjust the segmented track to a position in which the occupancy can operate optimally, a portion of the segmented track is broken off so that a bottom of the segmented track is generally flush with the bottom of the light fixture when installed. To attach the occupancy sensor to the light fixture, the threaded connector associated with the segmented track is inserted into the opening in the light fixture and secured to the threaded connector with a lock ring. The broken off portion of the segmented track may be inserted within a portion of the slot that remains open to block access within an interior of the occupancy sensor.

Referring now to the drawings, and more particularly to FIG. 1, an adjustable occupancy sensor is generally indicated at 10. As shown, the adjustable occupancy sensor 10 includes a housing 12 having a planar side 14 that is designed to engage a light fixture (shown in FIGS. 6A-6D). The housing 12 has a relatively narrow top 16 that tapers outwardly from the top of the housing to a bottom 18 of the housing. Provided at the bottom 18 of the housing is a sensor assembly, generally indicated at 20, which will be described in greater detail as the description of the adjustable occupancy sensor 10 proceeds.

Figure 2:
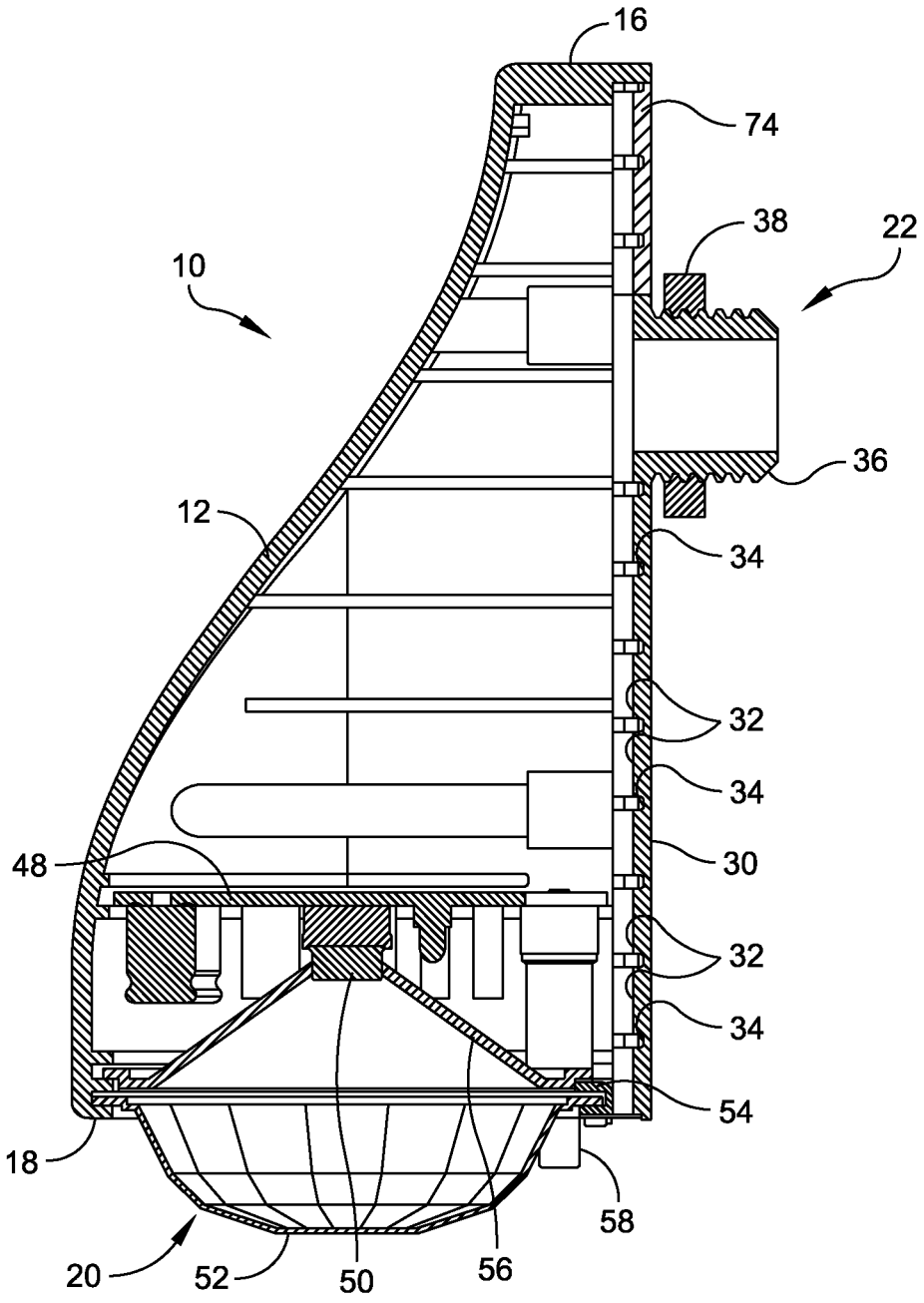
FIG. 2 is a cross-sectional view of the occupancy sensor taken along line 2-2 in FIG. 1.
Figure 3:
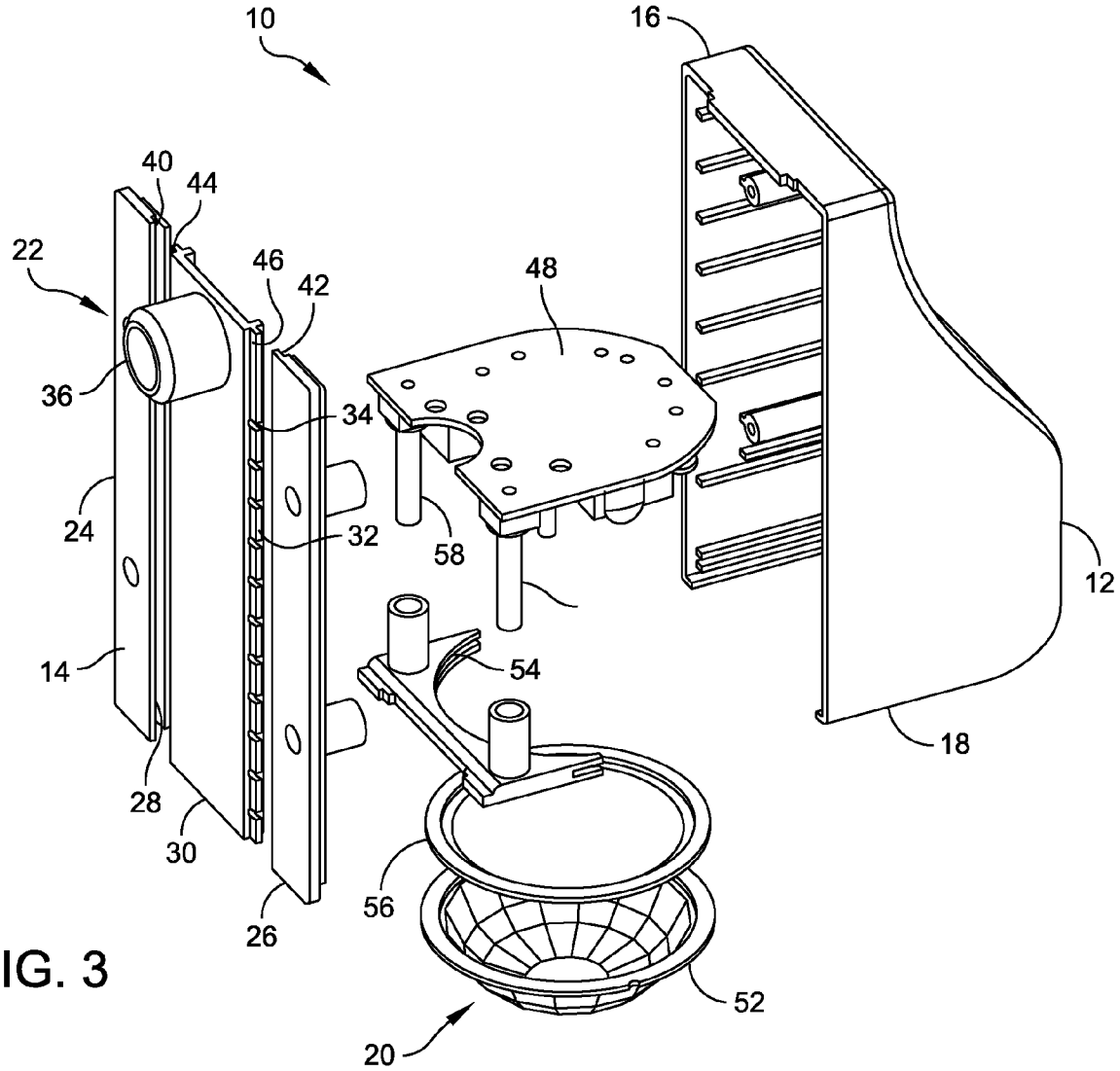
FIG. 3 is an exploded perspective cross-sectional view of the occupancy sensor.

Referring to FIGS. 2 and 3, the adjustable occupancy sensor 10 further includes an adjustable mounting assembly, generally indicated at 22, of embodiments of the disclosure, which is provided on the planar side 14 of the housing 12. In one embodiment, the adjustable mounting assembly 22 includes a pair of vertical rail members 24, 26 that are suitably secured to the housing 12. As shown, each rail member 24, 26 includes two bosses (not designated) that are configured to be aligned with mating bosses (not designated) associated with an interior of the housing. Once aligned, suitable fasteners (not shown) may be provided to secure the rail members 24, 26 to the housing 12. Once secured, the rail members 24, 26 define a vertical slot 28 positioned between the rail members. In a particular embodiment, the slot 28 may have a width that is approximately one inch in diameter, which may correspond to the diameter of an opening that accesses a wiring trough of a light fixture. The length of the slot 28 may be any suitable distance, such as six inches, which defines a range of offset distance adjustability typically required for a light fixture. Although the slot 28 is shown as being formed by the rail members 24, 26, the slot may be integrally formed within the housing 12. In addition, the width and length of the slot 28 may be selected to accommodate the particular application or opening diameter.

The adjustable mounting assembly 22 further includes an elongated, segmented track 30 that is sized to cover or otherwise be received within the slot 28. As shown, in one embodiment, the segmented track 30 has a plurality of segments, each indicated at 32, extending in a crosswise direction along the length of the segmented track. The segmented track 30 may include ten or more such segments 32, which are defined by grooves, each indicated at 34, spaced apart a predetermined distance, such as ⅜ inch. The grooves 34 extend in a direction that is generally perpendicular to the direction of the segmented track 30. Stated another way, the grooves 34 are formed to run between the long sides of the segmented track 30. The depth of these grooves 34 allows the installer to break the segmented track 30 at an interval corresponding to a preferred location with respect to the light fixture, which will be described in greater detail below when discussing the installation of the adjustable occupancy sensor 10 on the light fixture with reference to FIGS. 6A-6D. The segmented track 30 further includes a threaded connector 36 that extends away from the interior of the housing 12 when securing the segmented track 30 to the housing 12 in the manner described below. The threaded connector 36 may be molded as part of the segmented track or secured to the track by any suitable method. The threaded connector 36 includes a mating lock ring 38 that secures the adjustable occupancy sensor 10 to the light fixture. In some instances, the lock ring may be fabricated from metal or nylon, for example. The threaded connector 36 is adapted to be inserted into an opening formed within the housing of the light fixture, through a knockout for example, and secured to the housing of the light fixture with the lock ring 38. The arrangement is such that the housing of the light fixture is sandwiched between the body of the housing 12 of the adjustable occupancy sensor 10 and the lock ring 38.

Figure 4:
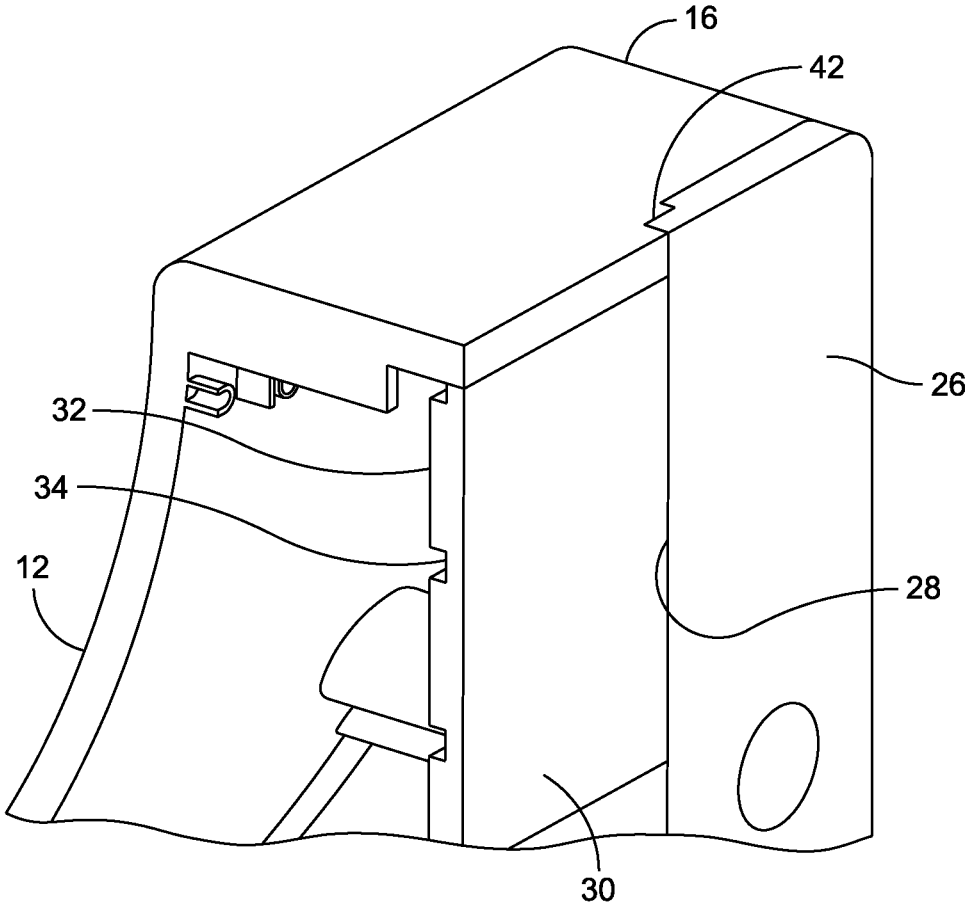
FIG. 4 is an enlarged perspective view of the occupancy sensor.

As discussed above, and with additional reference to FIG. 4, the segmented track 30 is configured to be releasably secured to the side 14 of the housing 12 in a position in which the segmented track is disposed within the slot 28. Long side edges 40, 42 of the rail members 24, 26 defining the slot 28 are each shaped with an interconnect configuration adapted to mate with an interconnect configuration associated with long side edges 44, 46 of the segmented track 30. As shown in FIG. 4, the mating side edges 40, 42, 44 and 46 of the segmented track 30 and the rail members 24, 26, respectively, interconnect in such a way that the housing 12 of the adjustable occupancy sensor 10 is secured to the segmented track while allowing the housing to slide vertically with respect to the segmented track. In one embodiment, the interconnect configurations may be a tongue-and-groove-type construction. In other embodiments, any type of interconnect construction may be employed that secures the segmented track 30 to the housing 12 and enables the segmented track to slide within the slot 28 of the housing.

The arrangement is such that the connector 36, when securing the segmented track 30 to the pair of rail members 24, 26, may be positioned at a desired height of the housing 12 of the adjustable occupancy sensor 10 by removing one or more segments 32 of the segmented track. The adjustability of the connector 36 and segmented track 30 with respect to the housing 12 enables the adjustable occupancy sensor 10 to accommodate any number of offset distances.

Referring back to FIGS. 2 and 3, in one embodiment, the sensor assembly 20 includes a circuit board 48 configured to be secured to the housing 12 within the interior of the housing. As shown, edges (not designated) of the circuit board 48 are received within slots (not designated) formed in the housing 12. The circuit board 48 is secured when the rail members 24, 26 are secured to the housing 12. In one embodiment, the circuit board 48 includes an electronic controller embedded within or attached to the circuit board. Attached to the circuit board 48 is a sensor 50, such as a pyroelectric sensor, which is suitably connected to the circuit board 48 and coupled to the electronic controller. The circuit board 48 may include other components required to enable the operation of the sensor assembly 20.

The sensor 50 is configured to detect the presence of a person in a room. The sensor assembly 20 further includes a lens 52, such as a Fresnel lens, secured to the housing 12 by a lens captivation bracket 54 and captured in place when the rail members 24, 26 are secured to the housing. An articulated finger guard 56 may be disposed between the circuit board 48 and the lens 52 and secured to the housing 12 by the bracket 54 to prevent access to the circuit board. In one embodiment, the finger guard may be fabricated from any suitable flame resistant material. One or more potentiometer knobs 58 may be provided to control or otherwise adjust the operation of the sensor 50.

Figure 5C:
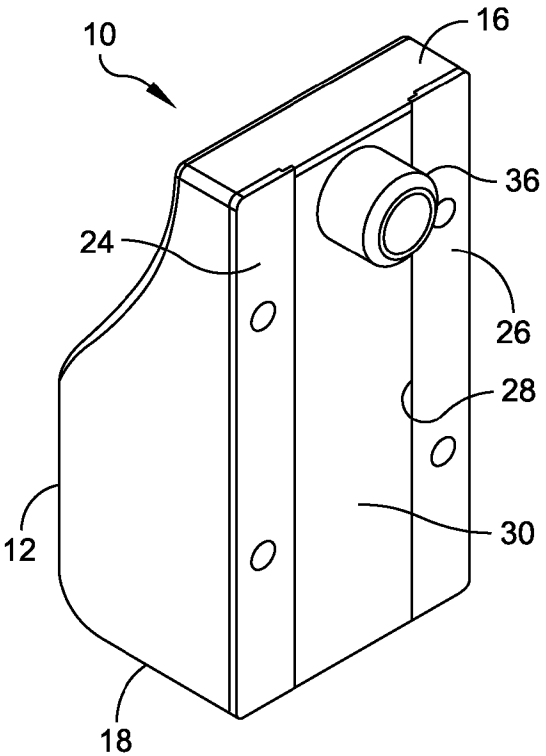
FIGS. 5A, 5B and 5C are perspective views showing different mounting positions of a threaded connector of the occupancy sensor.
Figure 5B:
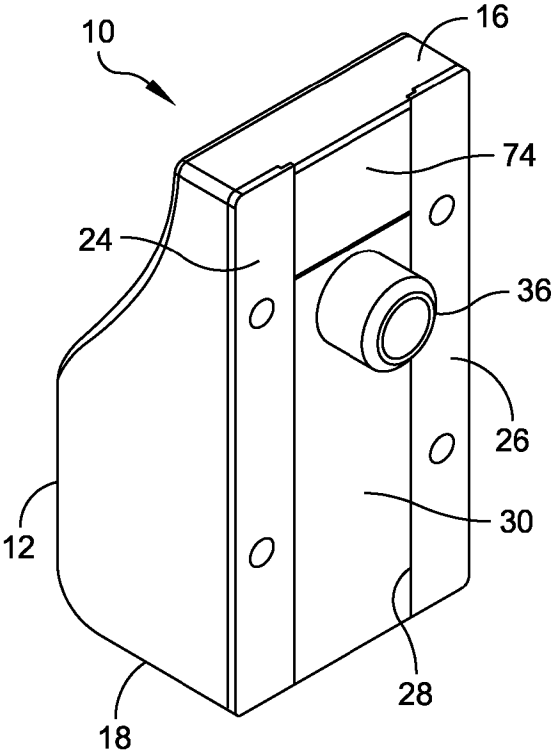
Figure 5A:
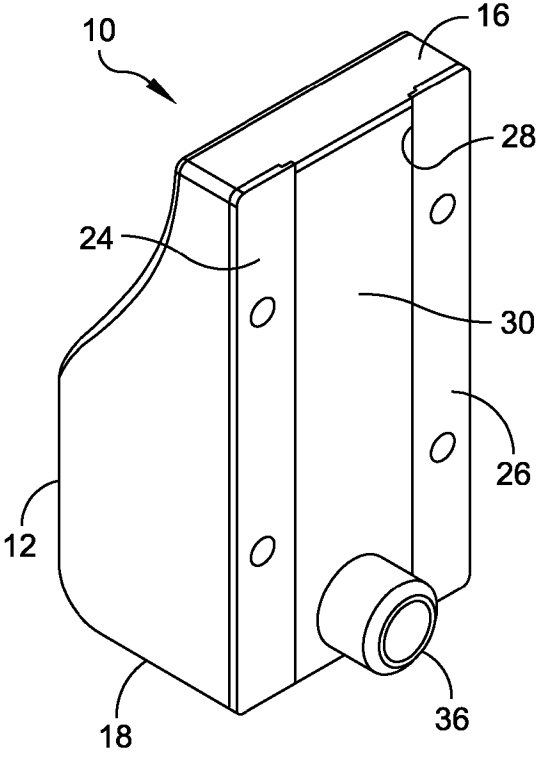

Thus, as best illustrated in FIGS. 5A, 5B and 5C, and by way of example only, the threaded connector 36 may be secured to the housing 12 at a desired elevation with respect to the housing. As shown in FIG. 5A, the threaded connector 36 is located adjacent the bottom 18 of the housing 12. In FIG. 5B, the threaded connector 36 is located a little above a midpoint between the top 16 and the bottom 18 of the housing 12. And in FIG. 5C, the threaded connector 36 is located adjacent the top 16 of the housing 12. In one embodiment, the configuration shown in FIG. 5A may be changed to the configuration shown in FIG. 5C by removing the segmented track 30 from the housing 12, rotating the threaded connector 36 and the segmented track one hundred and eighty degrees (180°) and inserting the segmented track back into the slot 28. By removing segments 32 of the segmented track 30, the length of the track may be adjusted to accommodate a specific offset distance.

Figures 6A, 6B, 6C, 6D:
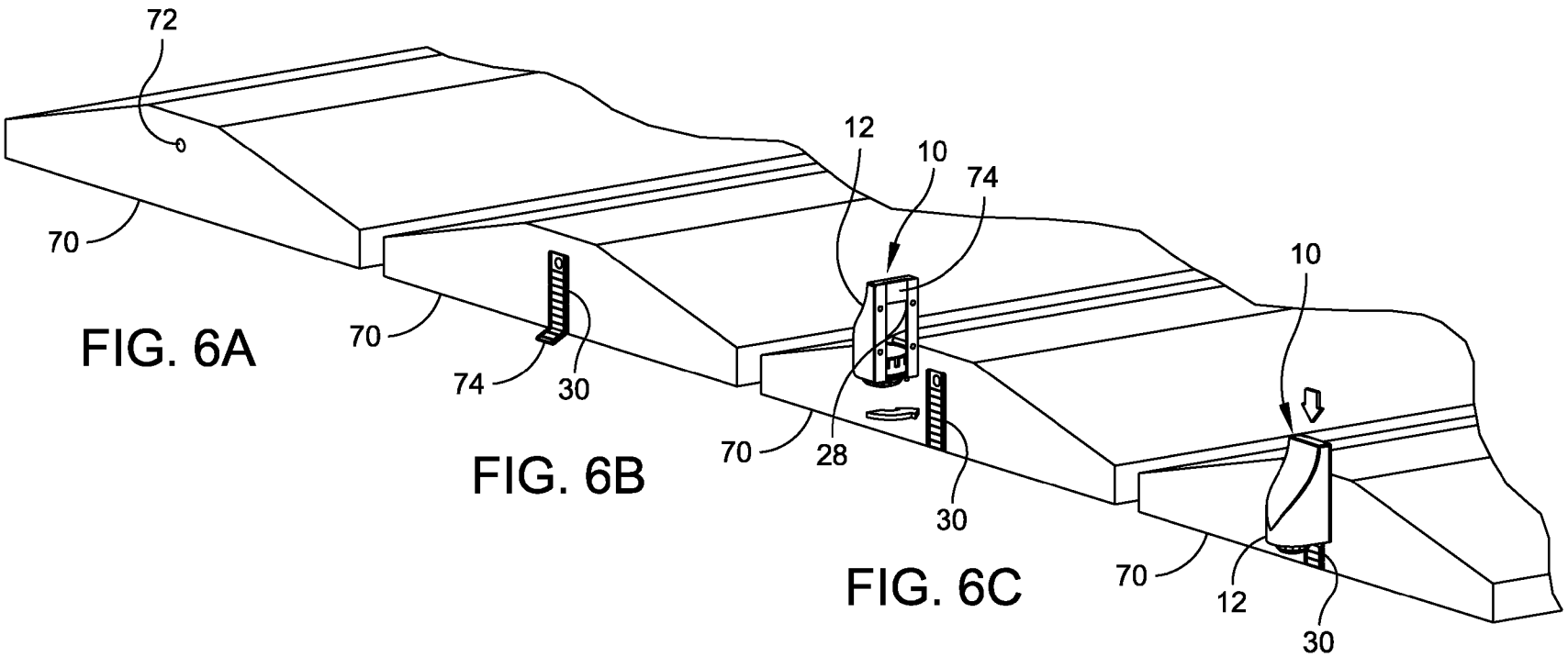
FIGS. 6A, 6B, 6C and 6D are perspective views showing the installation of the occupancy sensor on a light fixture.

In one embodiment, a method in which the adjustable occupancy sensor 10 is installed on a light fixture, such as light fixture 70 is illustrated in FIGS. 6A, 6B, 6C and 6D. FIG. 6A illustrates the light fixture 70 having a knockout removed to expose an opening 72 that leads to a wiring trough (not shown) of the light fixture. The installer of the adjustable occupancy sensor 10 may be required to remove the knockout to expose the opening 72 of the light fixture 70.

FIG. 6 B illustrates the segmented track 30 secured to the light fixture 70 by inserting the threaded connector 36 within the opening 72. It should be understood that the threaded connector 36 should be sized to fit within the opening 72 of the light fixture 70. As shown in FIG. 5B, a portion of the segmented track, indicated at 74, is bent and removed from the remaining portion of the segmented track 30. Specifically, the portion 74 of the segmented track 30 extending below a bottom edge 76 of the light fixture 70 is removed so that the bottom of the segmented track is generally flush with the bottom edge of the light fixture. The lock ring 38 is used to secure the connector 36 and the segmented track 30 to the light fixture 70. Thus, depending on the offset distance, the person installing the adjustable occupancy sensor 10 removes segments 32 of the track 30 to match or substantially match the length of the track 30 to the particular offset distance. It should be understood that the segmented track 30 may be broken off prior to installing the segmented track on the light fixture 70. FIG. 6B is provided to clearly show the segmented track 30 secured to the light fixture 70.

FIG. 6C illustrates broken off portion 74 being inserted into the top portion of the slot 28 of the housing 12 of the occupancy sensor 10 to block access within an interior of the adjustable occupancy sensor. The arrangement is such that the segmented track 30 and the broken off portion 74 completely block the slot 28 when securing the housing 12 of the adjustable occupancy sensor 10 to the segmented track. After inserting the broken off portion 74 into the slot 28, the housing 12 of the adjustable occupancy sensor 10 is secured to the segmented track at a desired position with the broken off portion being positioned adjacent the segmented track. However, as mentioned above, during most installations, the segmented track 30 is already secured to the housing 12 prior to installing the occupancy sensor on the light fixture 70. The arrangement is such that the segmented track 30 is aligned with the slot 28 of the housing 12 of the adjustable occupancy sensor 10, with the long side edges 40, 42 of the rail members 24, 26 interconnecting with the long side edges 44, 46 of the segmented track 30 so as to enable the housing of the adjustable occupancy sensor to slide vertically with respect to the segmented track when securing the housing to the segmented track.

FIG. 6D illustrates the movement of the housing 12 of the adjustable occupancy sensor 10 with respect to the segmented track 30 during installation. As shown, the housing 12 is positioned at a desired elevation with respect to the bottom edge 76 of the light fixture 70 to maximize the effective range and operation of the adjustable occupancy sensor 10.

As described, with most installations, the method of installing the adjustable occupancy sensor 10 to the light fixture 70 includes determining an offset distance prior to mounting the housing 12 of the adjustable occupancy sensor to the light fixture. In situations in which the installer knows the type of light fixture on which the adjustable occupancy sensor 10 is to be installed, the installer will know the offset distance. Thus, the installer may bypass the steps of securing the segmented track 30 to the light fixture 70 and securing the housing 12 of the adjustable occupancy sensor 10 to the track, and go directly to breaking off a portion or segments 32 of the segmented track based on the known offset distance. As with the prior method, the broken off portion of the segmented track 30 is inserted within a portion of the slot 28 that remains open to block access within an interior of the housing 12 of the adjustable occupancy sensor 10. In another method, the broken off portion of the segmented track 30 may be discarded. Once assembled, the opening 72 is exposed and the adjustable occupancy sensor 10 is mounted directly to the light fixture 70.

In yet another embodiment, the segmented track 30 may be configured with an additional amount of segments, thus making the track longer than the slot 28 formed in the housing 12. In this embodiment, the broken off portion of the segmented track 30 may not be used to fill in the upper end of the slot 28 and may be discarded.

Figure 7:
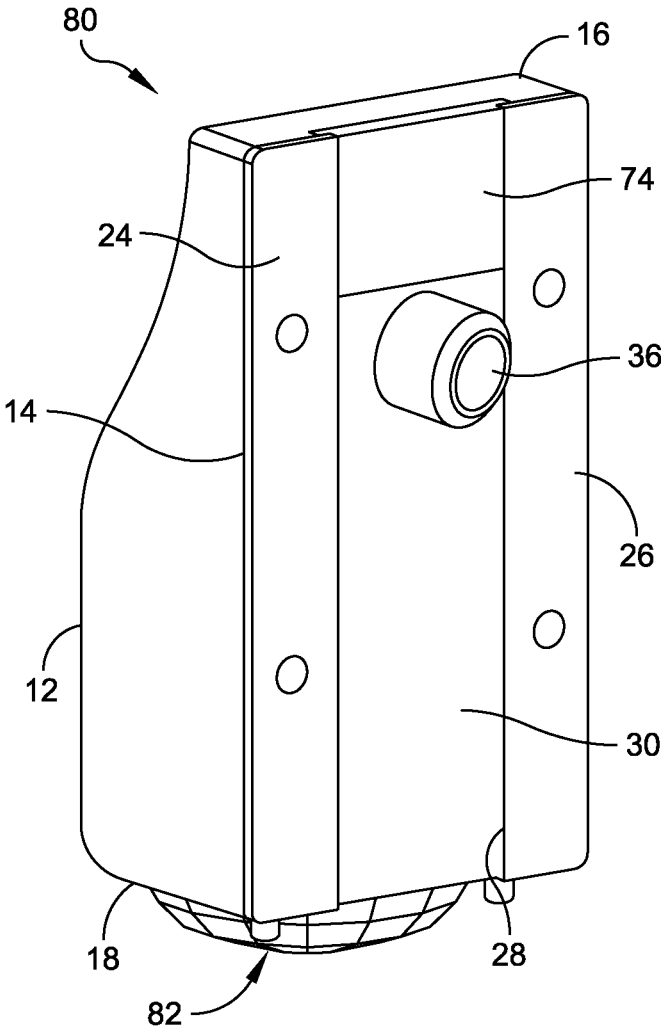
FIG. 7 is a perspective view of an adjustable device of another embodiment of the disclosure.

Referring to FIG. 7, an adjustable electronic device, generally indicated at 80, is configured to be attached to a light fixture. In one embodiment, the adjustable electronic device 80 includes a housing 12 having a side 14 and a bottom 18. In place of sensor assembly 20, an electronic component, generally indicated at 82, is attached to the housing at the bottom of the housing in a manner similar to which the sensor assembly 20 is attached to the housing. The adjustable electronic device 80 further includes an adjustable mounting assembly provided on the side 14 of the housing 12. In one embodiment, as with occupancy sensor 10, the adjustable mounting assembly includes a slot 28 defined in the side 14 of the housing, a track 30 configured to be releasably secured to the side of the housing within the slot, and a connector 36 coupled to the track to connect the housing of the device 80 to the light fixture. In a particular embodiment, a camera may be provided as the electronic component 82. However, it should be understood that in situations requiring an electronic device to be mounted on a light fixture, such as a fluorescent light fixture, any type of electronic device may be supported by the housing 12 of the adjustable electronic device 80 and fall within the scope of the present disclosure. For example, a smoke detector, an accent light, a light level sensor, a speaker, an indicator, such as an LED indicator, or another type of sensor may be provided as the electronic device.

Embodiments of the adjustable occupancy sensor may include housings of various shapes and sizes, and is not limited to the housing illustrated in the drawing figures. In addition, the adjustable occupancy sensor may include any type of sensor assembly suitable for detecting the presence of a person, for example, in a space. Also, as discussed above, the adjustable occupancy sensor may be configured to mount to any type of light fixture, not just fluorescent light fixtures, or any other type of structure. For example, the housing may be configured to mount on a conduit box. Further, the interconnect configurations may be any type of construction suitable for connecting the housing of the adjustable occupancy sensor to the segmented track.

Thus, it should be observed that embodiments of the adjustable occupancy sensor disclosed herein eliminate the need for offset adapters when connecting the occupancy sensor to the light fixture. In addition, the embodiments of the adjustable occupancy sensor disclosed herein enable a more secure connection of wiring between the light fixture and the occupancy sensor. The installer of the adjustable occupancy sensor may customize the sensor to accommodate light fixtures having different offset requirements.

Having thus described at least one embodiment of the present disclosure, various alternations, modifications and improvements will readily occur to those skilled in the art. Such alterations, modifications and improvements are intended to be within the scope and spirit of the disclosure. Accordingly, the foregoing description is by way of example only and is not intended to be limiting. The disclosure's limit is defined only in the following claims and equivalents thereto.

What is claimed is:

1. An adjustable occupancy sensor for a light fixture, the adjustable occupancy sensor comprising:

a housing having a side and a bottom;

a sensor assembly attached to the housing at the bottom of the housing; and an adjustable mounting assembly provided on the side of the housing, the adjustable mounting assembly including an elongated slot formed in the side of the housing, a track configured to be releasably secured to the side of the housing within the elongated slot in a desired position along a length of the elongated slot, and a connector coupled to the track to connect the housing of the adjustable occupancy sensor to the light fixture, wherein the track has a plurality of segments extending along the length of the track, the plurality of segments being configured to be breakable from the track to adjust a length of the track and a position of the connector with respect to housing.

2. The adjustable occupancy sensor of claim 1, wherein the sensor assembly includes a circuit board configured to be secured to the housing, the circuit board having an electronic controller and at least one sensor coupled to the electronic controller, the sensor being configured to detect the presence of a person in a room.

3. The adjustable occupancy sensor of claim 1, wherein the connector includes a threaded portion and a threaded fastener configured to be threadably connected to the threaded portion, the threaded portion and the threaded fastener being constructed and arranged to secure the housing of the adjustable occupancy sensor to a housing of the light fixture.

4. The adjustable occupancy sensor of claim 1, wherein the segments of the track are defined by grooves formed in the track between adjacent segments, and wherein the segments are constructed and arranged to be removable from the track and inserted into the elongated slot adjacent the track.

5. The adjustable occupancy sensor of claim 4, wherein the grooves extend in a direction perpendicular to a direction of a length of the track.

6. The adjustable occupancy sensor of claim 1, wherein the housing includes a pair of rail members defining the elongated slot, the track being configured to be releasably secured to the pair of rail members and positioned within the elongated slot.

7. The adjustable occupancy sensor of claim 6, wherein the track includes an interconnect configuration adapted to mate with an interconnect configuration of the pair of rail members.

8. The adjustable occupancy sensor of claim 6, wherein the track is slidable within the elongated slot to position the connector at a desired height with respect to the bottom of the housing.

9. A method of installing an occupancy sensor on a light fixture having an opening positioned to access wiring of the light fixture, the method comprising:

providing an adjustable occupancy sensor having a housing and a track releasably securable to the housing within an elongated slot formed in the housing, the track forming part of the housing of the occupancy sensor when attached to the housing;

releasably securing the housing of the occupancy sensor to the track within the elongated slot along a length of the elongated slot in a position in which a bottom surface of the housing of the occupancy sensor is at a desired position with respect to a bottom of the light fixture when installing the occupancy sensor to the light fixture;

securing the track to the light fixture, the track having a connector configured to be inserted within the opening in the light fixture; and breaking off a portion of the track so that a bottom of the track is flush with the bottom of the light fixture.

10. The method of claim 9, further comprising inserting the broken off portion of the track within an opening of the housing of the occupancy sensor to block access to an interior of the occupancy sensor.

11. An adjustable occupancy sensor configured to be secured to any one of a plurality of light fixtures, each of the light fixtures having a mounting opening located at a distance from a bottom of the light fixture with the distance being different for each light fixture, the adjustable occupancy sensor comprising:

a housing having a side and a bottom;

a sensor assembly attached to the housing; and means for adjustably securing the housing to the mounting opening of any one of the plurality of light fixtures to locate the sensor assembly at a desired position on one of the plurality of light fixtures, wherein the means for adjustably securing the housing to the light fixture includes a pair of rail members defining an elongated slot and a track releasably securable to the pair of rail members within the elongated slot along a length of the elongated slot, wherein the track has a plurality of segments extending along the length of the track, the track being configured to be releasably secured to the side of the housing within the elongated slot, the plurality of segments being configured to be broken from the track to adjust a length of the track and a position of the connector with respect to housing.

12. The adjustable occupancy sensor of claim 11, wherein the track includes a connector to connect the housing of the adjustable occupancy sensor to the mounting opening.

13. The adjustable occupancy sensor of claim 12, wherein the connector includes a threaded portion and a threaded fastener configured to be threadably connected to the threaded portion.

14. The adjustable occupancy sensor of claim 11, wherein the track includes an interconnect configuration adapted to mate with an interconnect configuration of the pair of rail members.

* * * * *